US005274967A

United States Patent [19]

Mladichek

[11] Patent Number: 5,274,967

[45] Date of Patent: Jan. 4, 1994

[54] ROOF ASSEMBLY

[75] Inventor: Branko Mladichek, Hoppers Crossing, Australia

[73] Assignee: Mladichek Nominees Pty. Ltd., Hoppers Crossing, Australia

[21] Appl. No.: 768,246

[22] PCT Filed: Apr. 19, 1990

[86] PCT No.: PCT/AU90/00157

§ 371 Date: Oct. 15, 1991

§ 102(e) Date: Oct. 15, 1991

[87] PCT Pub. No.: WO90/12933

PCT Pub. Date: Nov. 1, 1990

[30] Foreign Application Priority Data

Apr. 21, 1989 [AU] Australia ..... PJ3831

[51] Int. Cl.[5] ..... E04B 7/16

[52] U.S. Cl. ..... 52/93.1; 52/126.1; 52/126.5; 52/745.2

[58] Field of Search ..... 52/90, 126.1, 745, 126.5

[56] References Cited

U.S. PATENT DOCUMENTS

| | | | |
|---|---|---|---|
| 4,015,389 | 4/1977 | Thompson | 52/475 |
| 4,162,595 | 7/1979 | Ramos et al. | 52/69 |
| 4,570,396 | 2/1986 | Struben | 52/90 |
| 4,773,192 | 9/1988 | Andrews | 52/90 |
| 4,802,316 | 2/1989 | Kelly et al. | 52/90 |
| 4,858,398 | 8/1989 | Ricchini | 52/90 |

FOREIGN PATENT DOCUMENTS

| | | |
|---|---|---|
| 106241 | 4/1942 | Australia . |
| 2235456 | 4/1957 | Australia . |
| 3341257 | 4/1959 | Australia . |
| 265361 | 8/1963 | Australia . |
| 2291477 | 9/1978 | Australia . |
| 1395947 | 5/1975 | United Kingdom . |
| 2061349 | 5/1981 | United Kingdom . |

*Primary Examiner*—Carl D. Friedman
*Assistant Examiner*—Matthew E. Leno
*Attorney, Agent, or Firm*—Price, Heneveld, Cooper, DeWitt & Litton

[57] ABSTRACT

A roof assembly includes a frame having primary beams, secondary beams mounted transversely on the primary beams, and a ceiling grid suspended from the secondary beams. A method of assembling the roof assembly includes assembling the primary beams over the ceiling grid and connecting the secondary beams to the primary beams. The assembly is assembled on the ground and lifted to a fully installed position using a transportable lift.

27 Claims, 8 Drawing Sheets

ROOF ASSEMBLY

BACKGROUND OF THE INVENTION

The present invention relates to roof assemblies and a method of installing a roof assembly to form the roof of a building such as a factory or commercial building.

Normally a building is constructed by installing the foundations and floors, constructing a framework for the walls and roof, and then installing the elements which make up the walls, ceiling and roofing, The plumbing and wiring are usually installed once the shell of the building has been constructed.

Typically, the roof of a building in particular is constructed in situ, that is, above the ground. Constructing anything above ground level adds to the cost of construction.

Where buildings have been required in locations having high construction costs, they have been fabricated in modules that have been transported to the site and assembled in situ thereby considerably reducing the cost of labour required at the site. However, to be transportable such modular buildings have lacked aesthetic appeal and when the high cost of transport is taken into account, have not been competitive in situations where construction labour is readily available.

Because the roof of a building is largely assembled above the ground it usually represents a disproportionately high component of the total cost of construction. There is therefore a considerable economic advantage to be obtained by assembling a roof on the ground and lifting it into position as a unitary structure.

Patent application Ser. No. 22914/77 describes a prefabricated roof structure having an underlying peripheral support to provide rigidity so that the structure can be raised as a unit. The prefabricated structure described includes roof trusses, fasica, guttering and rafters. The structure is supported at a level slightly above the ground while tiling or roof sheeting is applied to the frame. The structure is then raised so that the ceiling and soffits can be readily fitted from ground level. The roof structure may be raised by hydraulic or mechanical jacks or cranes according to circumstances.

The proposal described in patent application Ser. No. 22914/77 suffers from a number of disadvantages. Firstly the roof is so designed that it is necessary to add a peripheral support to provide rigidity. The additional materials and time required to construct the support add to the cost of the structure. Secondly the multi-lift assembly of the structure, adds to the cost and increases the risk of accidents arising especially while the ceiling is being installed. An objective of the present invention is therefore to reduce the cost of constructing and installing building roofs and overcome the problems associated with previous proposals.

SUMMARY OF THE INVENTION

Accordingly, the present invention provides a non-transportable roofing assembly for a new building comprising a frame, roof cladding elements and ceiling elements but no additional peripheral support structure, the roofing assembly being specifically designed to be assembled on the ground and lifted into position as an assembly using transportable lifting means.

The assembly design takes account of lifting rigidity, total weight, location of lifting points, type of lifting means to be used, stability during erection, securing and safety.

In another aspect of the present invention there is provided a method of constructing a building roof comprising designing a footing assembly to be assembled on the ground and lifted into position using transportable lifting means, constructing a roof frame on the ground near a building to be roofed using elements having a high strength to weight ratio, installing ceiling and filing elements on the frame to form a roof assembly, lifting the roof assembly into position using transportable lifting means, and securing the roof assembly to load bearing columns forming part of said building.

The transportable lifting means may comprise one or more chain blocks or mobile cranes.

If chain blocks are to be used to raise the assembly into position, the assembly will be constructed directly below its installed position. Power for the chain blocks may be supplied from the power lines installed within the assembly. Once the roofing assembly has been raised to its installed position, the primary beams can be bolted to neighbouring load bearing columns.

The roof frame may be formed from primary beams made from universal beams, channels or cold rolled Z sections and secondary beams or purlins formed from c or z metal cold rolled sections. The primary beams may be spaced such that the distance between them lies in the range between 4 and 12 meters. The secondary beams may be spaced such that the distance between them lies in the range from 0.3 to 2 meters. The roof cladding elements may be any metal deck such as for example, Lysaght Brownbuilt "Trimdek". The ceiling elements may be "Rondo" or similar suspended ceiling grids having plaster ceiling tiles.

Preferably the roof ash a pitch of less than 10 degrees.

Preferably also, electrical wiring, lights, gutters, skylights, vents, fascias, insulation and any ducting are installed prior to lifting the roofing assembly into position.

A particularly preferred method of constructing a roof according to the present invention comprises the steps of:

(1) laying out primary beams and a ceiling grid,
(2) installing load bearing columns,
(3) positioning the primary beams,
(4) assembling the ceiling grid,
(5) fixing purlins to the primary beams to form a frame,
(6) connecting the ceiling grid to the purlins,
(7) installing electrical wiring and lights,
(8) dropping ceiling panels into position,
(9) fixing roof cladding to the frame and installing insulation,
(10) installing gutters, skylights, vents and fascias,
(11) preparing lifting points.
(12) lifting the roofing assembly into position on the load bearing columns using chain blocks or mobile cranes,
(13) securing the roofing assembly to the load bearing columns,
(14) bracing the load bearing columns to improve their load bearing capacity,
(15) removing the chain blocks or mobile cranes and
(16) finishing off around the load bearing points.

Ideally the method of the present invention forms part of a method for very fast building construction. This preferably involves the off-site construction of service room modules such as kitchens, bathrooms and toilets for subsequent installation in the building in a completely assembled state. Typically such a method involves the following steps:

(1) constructing foundations,
(2) forming a concrete slab,
(3) installing load bearing columns,
(4) constructing a roof according to the method of the present invention simultaneously with the preceding steps,
(5) installing service modules constructed off-site,
(6) constructing external and internal walls, and
(7) completing fit-out and finishing off.

Preferably very fast building construction also includes utilization in the pre-construction period of an integrated site management system. Such a system involves testing and assessing a construction site, preparing the site ready for construction, certifying the site for particular types of construction and maintaining it ready for construction. This system is more particularly described in co-pending patent application Ser. No. PJ8340.

BRIEF DESCRIPTION OF THE INVENTION

DESCRIPTION OF THE PREFERRED EMBODIMENT

Figure 1:
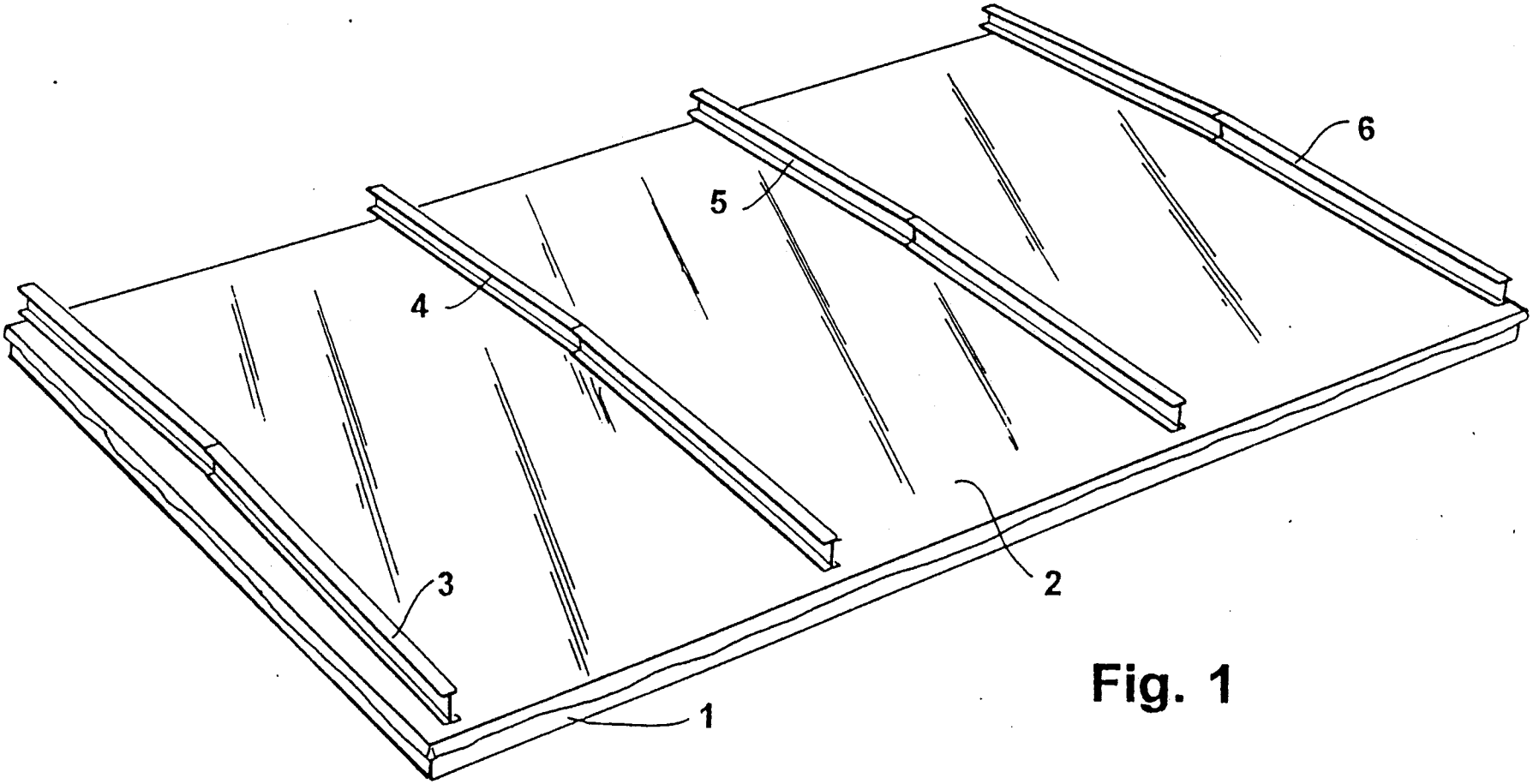
FIG. 1 is a perspective view of a concrete slab having a polyethylene sheet and primary beams positioned thereon.

FIG. 1 depicts a concrete slab 1 having a sheet of polyethylene 2 placed over its upper surface. Primary beams 3, 4, 5 and 6 are then laid out across the polythene 2 placed. Primary beams 3, 4, 5 and 6 may be laid out across the concrete slab with a clearance of about 50 mm from the upper surface of the slab 1.

Figure 2:
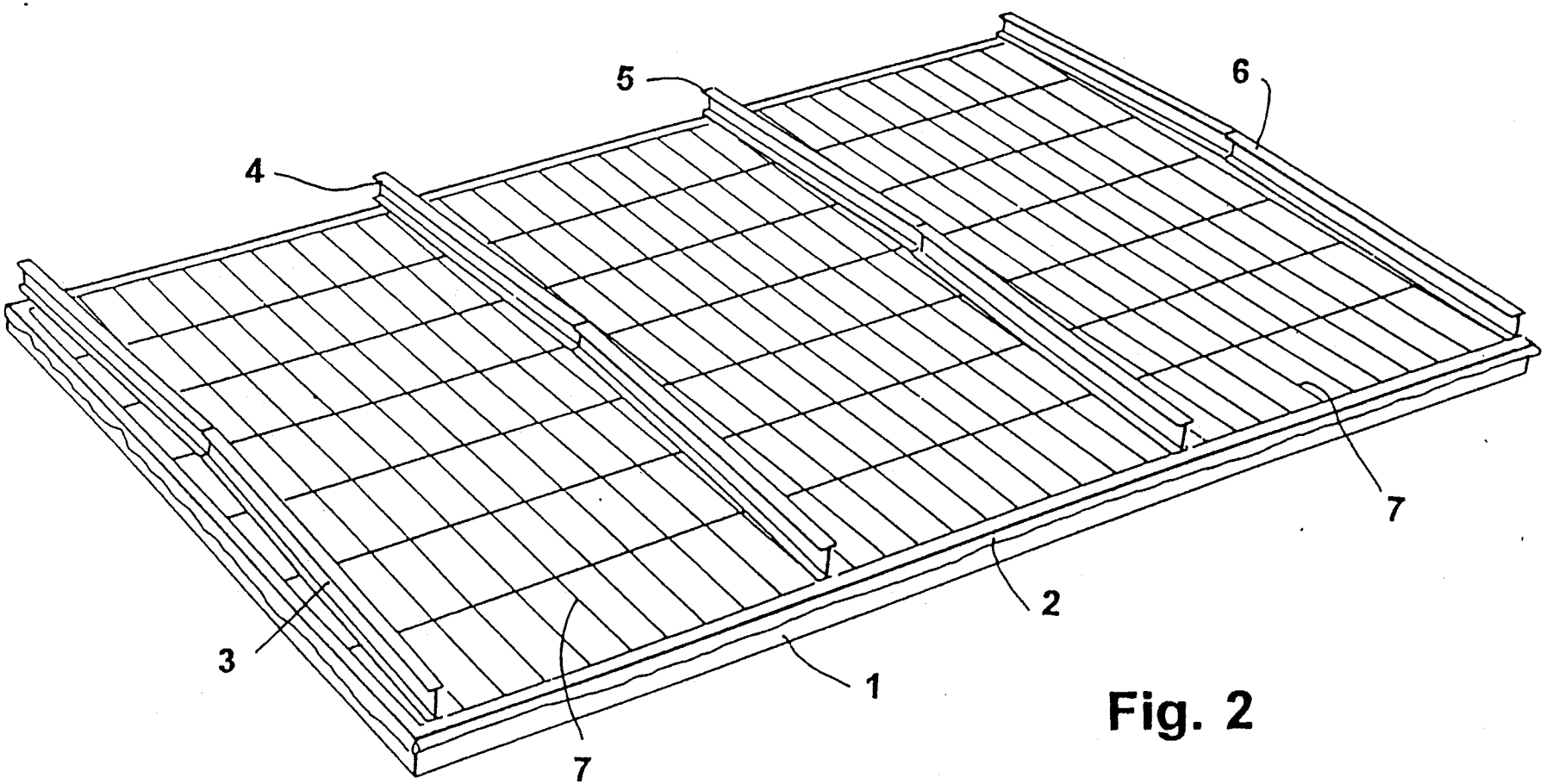
FIG. 2 is a perspective view of the concrete slab, polyethylene sheet and primary beams according to FIG. 1 and further including a ceiling grid.
Figure 3:
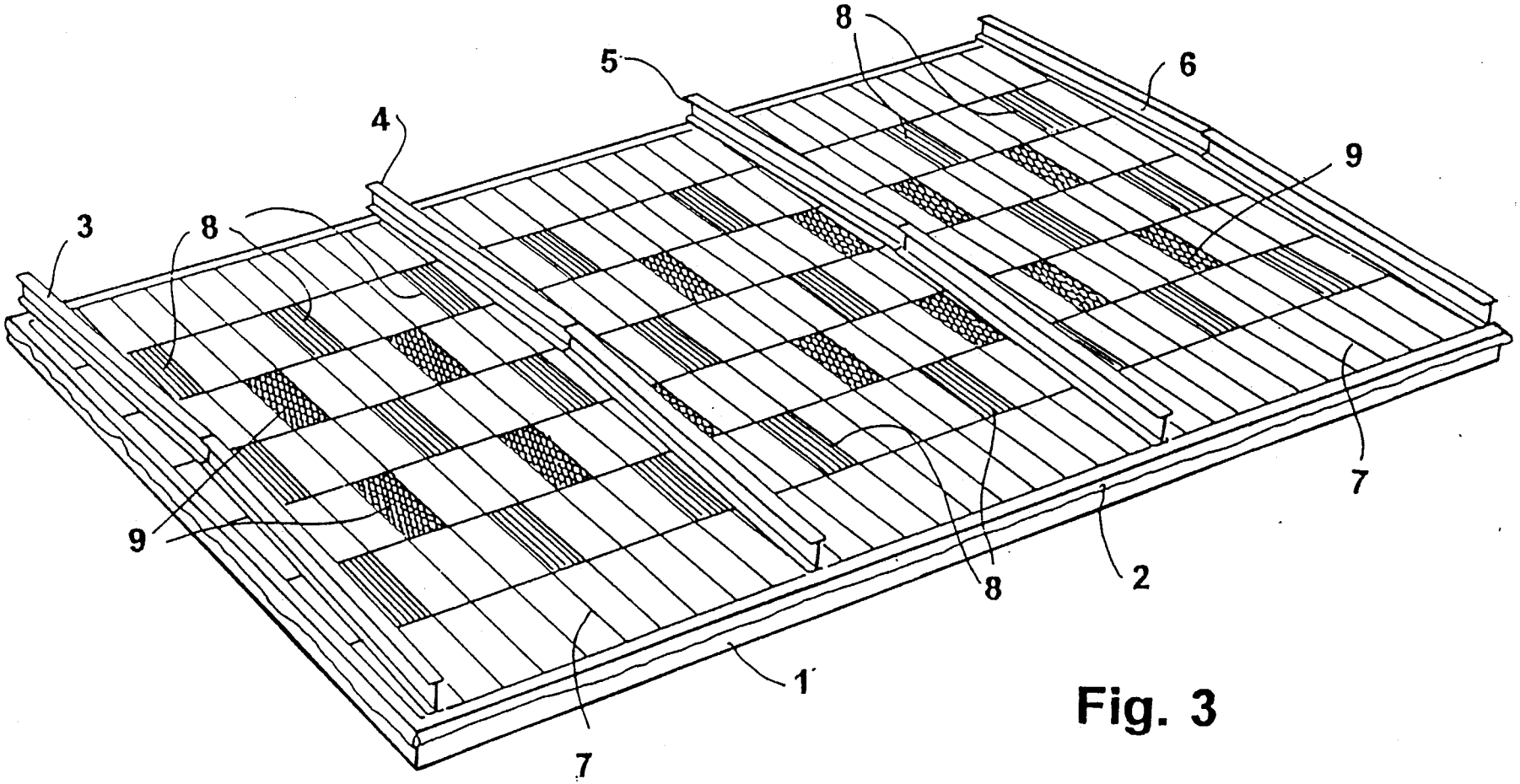
FIG. 3 is a perspective view of the roof assembly according to FIG. 2, and further including lighting and ventilation points.
Figure 4:
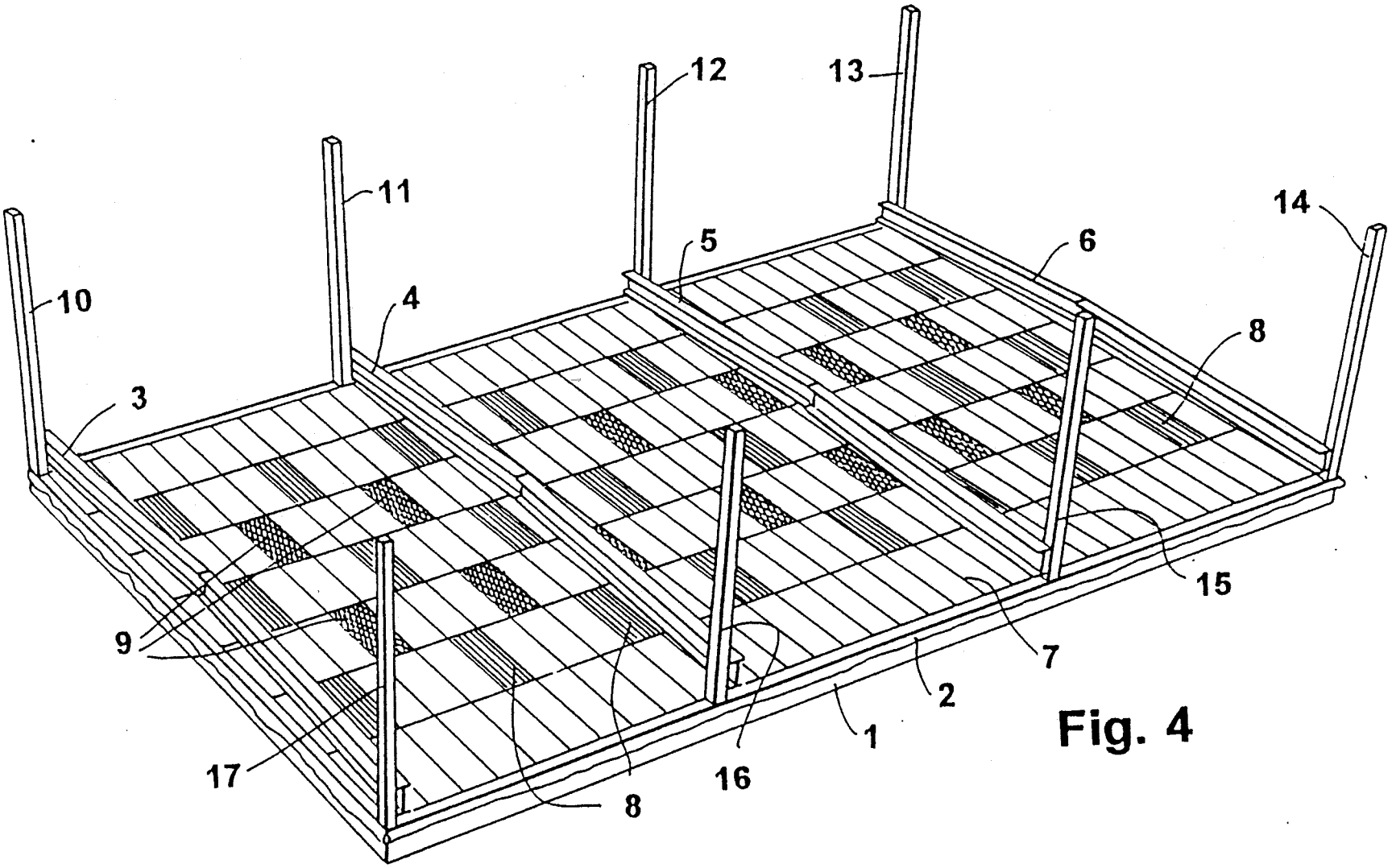
FIG. 4 is a perspective view of the roof assembly according to FIG. 3, and further including load bearing columns.

FIG. 2 depicts a ceiling grid 7 laid out between the primary beams 3, 4, 5 and 6. The 50 mm clearance enables the ceiling grid 7 to be laid out under the primary beams. Lighting points 8 and ventilation points 9 are inserted in the ceiling grid as shown in FIG. 3 Ceiling tiles may be installed at this stage or after the roof has been raised. Load bearing columns 10, 11, 12, 13, 14, 15, 16 and 17 are installed in the slab adjacent to the ends of the primary beams (FIG. 4).

Figure 5:
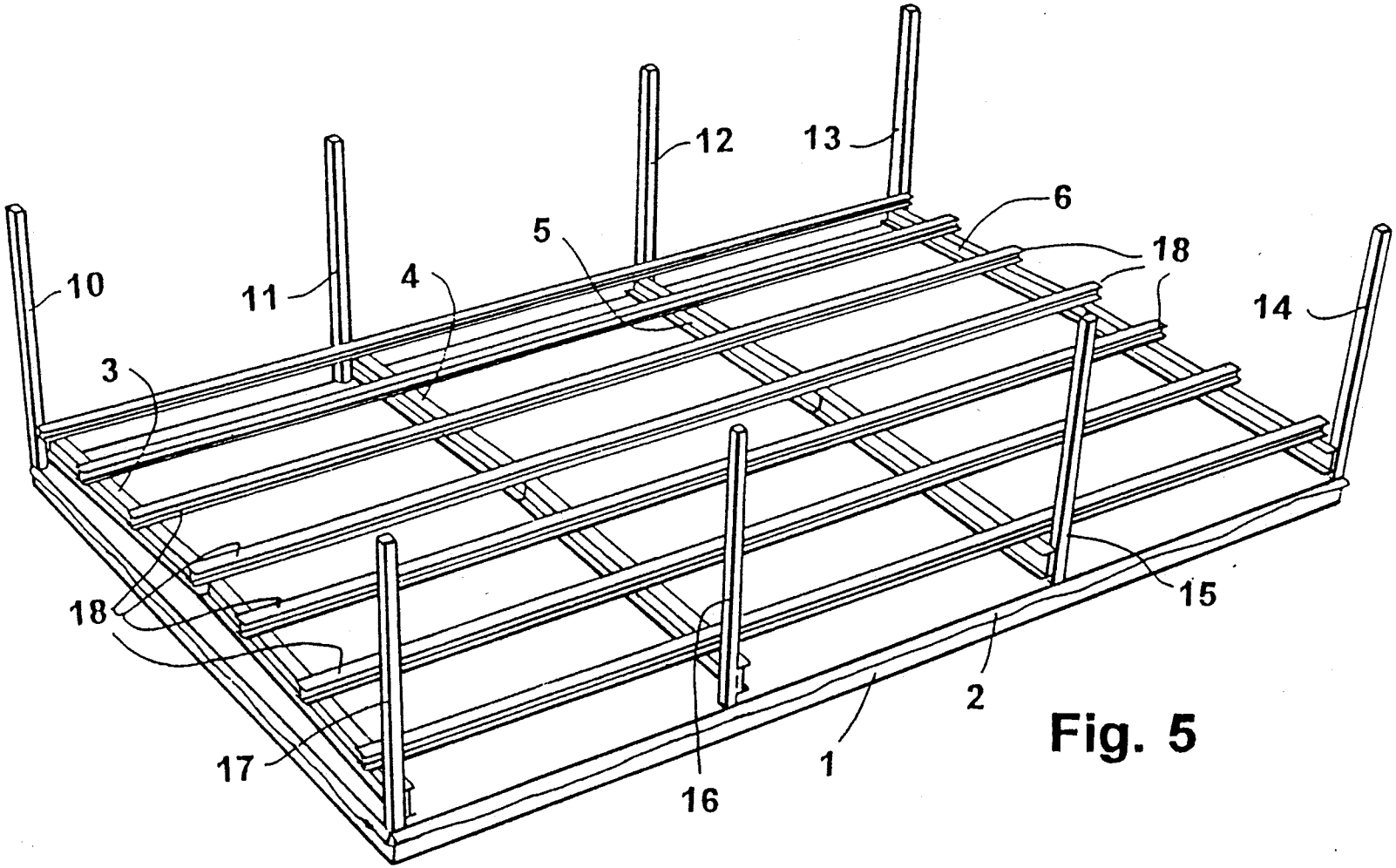
FIG. 5 is a perspective view of the roof assembly according to FIG. 4, and further including secondary beams.

FIG. 5 depicts the concrete slab, the primary beams and the load bearing columns without the ceiling grid and attached lighting and ventilation points. Purlins or secondary beams 18 are laid out in a direction transverse to the primary beams 3, 4, 5, 6. The secondary beams are connected to the primary beams and the ceiling rid is connected to the secondary beams.

Ideally gutters, gutter boards and wiring (not shown) are installed at this stage. All fascias 25, (FIG. 7) flashings, gutters, skylights, vents, services and other installations are completed ready for elevation of the roof.

Figure 6:
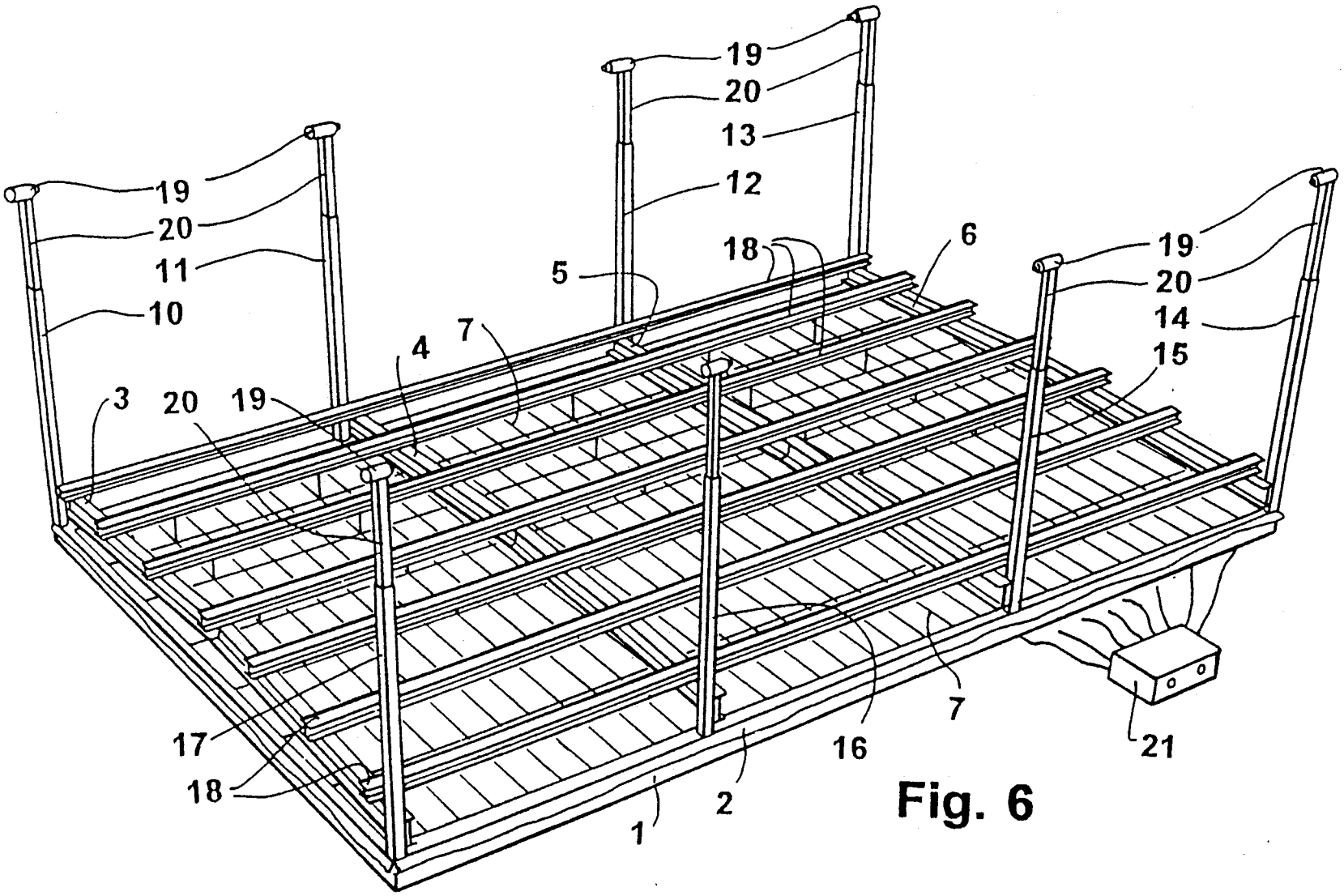
FIG. 6 is a perspective view of the roof assembly according to FIG. 5, and further including extension, chain blocks and a control box.

The load bearing columns, 10, 11, 12, 13, 14, 15, 16 and 17 are extended by means of extension 20 and chain blocks 19 are attached to the top of the extensions as shown in FIG. 6. The electric chain blocks 19 are controlled from a central control box 21 and the roofing assembly raised to its erected position as shown in FIG. 7.

Figure 7:
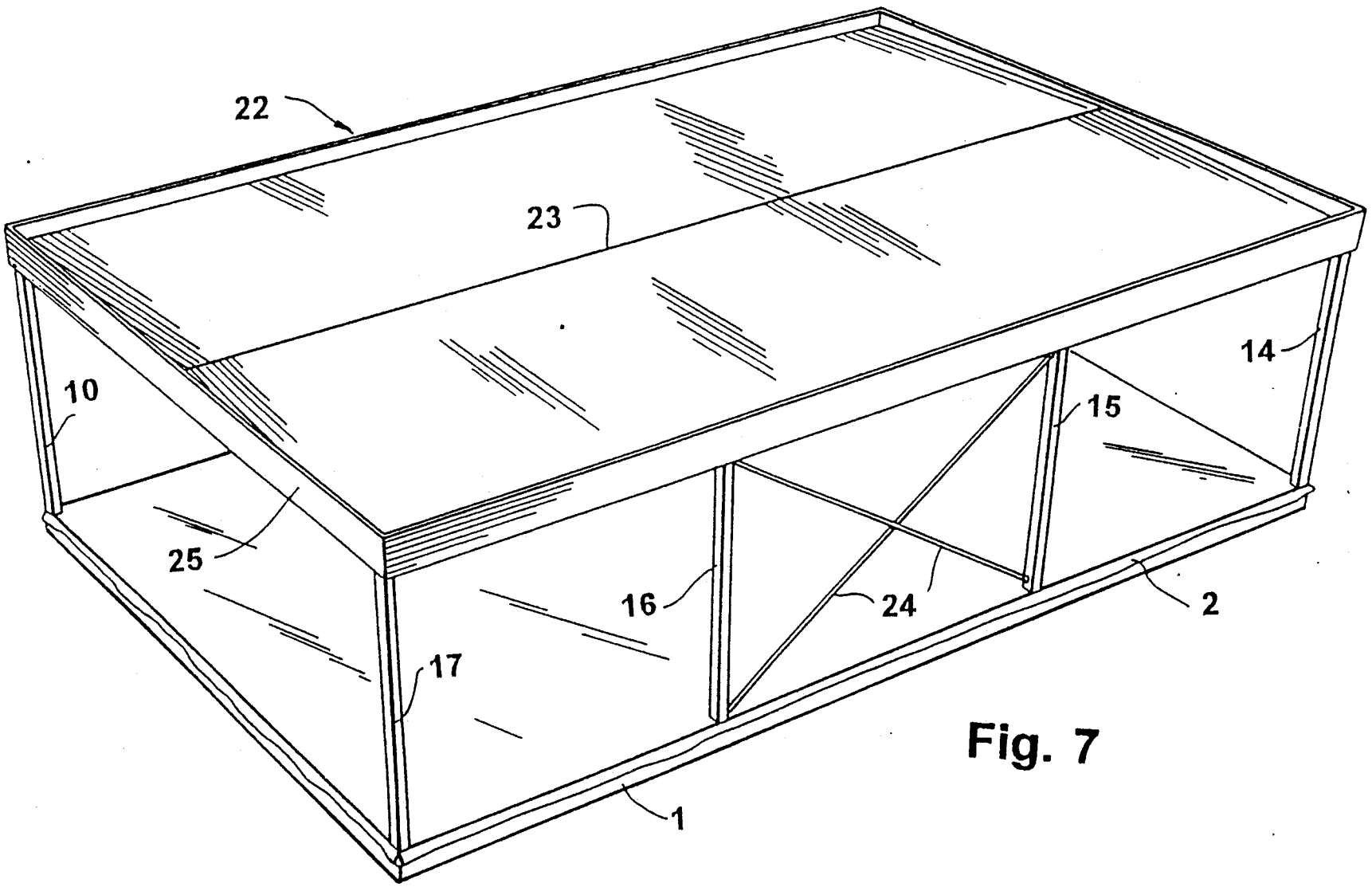
FIG. 7 is a perspective view of the roof assembly according to FIG. 6 in the erected position.
Figure 8:
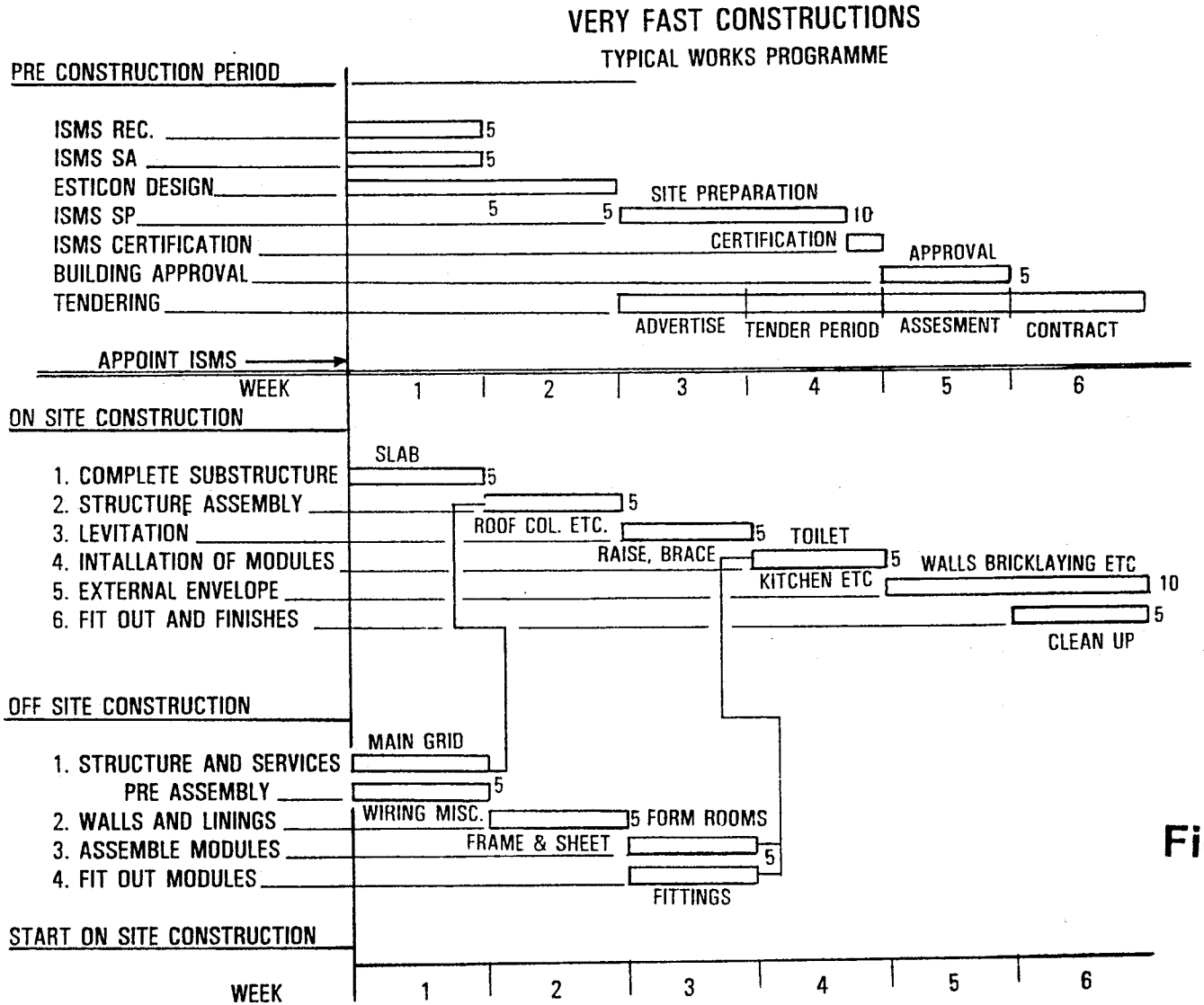
FIG. 8 is a construction schedule.

FIG. 7 depicts the roofing assembly 22 in its erected position. The roof has a ridge line 23 and a pitch of less than 10 degrees. Bracing 24 is installed between columns 15 and 16 and columns 11 and 12 (not shown).

It will become apparent to those skilled in the art that various modifications to the preferred embodiment described and disclosed herein can be made. Such modifications will be considered as within the scope of the claims appended herebelow unless such claims by their language expressly state otherwise.

I claim:

1. An integrated roofing assembly for a new building, the assembly comprising:

a ceiling grid assembled on the ground at a construction site and adapted to support ceiling tiles;

a frame, said frame including primary beams positioned on said ceiling grid and arranged parallel to each other, and secondary beams positioned on and connected to said primary beams and arranged transversely to said primary beams, said ceiling grid being located beneath said frame and being connected to said secondary beams, and said frame having lifting points;

roof cladding elements coupled to said frame, said primary and secondary beams acting together to structurally support said roof cladding elements;

whereby said roofing assembly is assembled on the ground as an integrated unit without additional peripheral support structure for lifting into a fully installed position using transportable lifting means removably coupled to said lifting points.

2. An integrated roofing assembly according to claim 1 wherein said primary beams are selected from a group consisting of universal beams, channels and Z cold rolled metal sections.

3. An integrated roofing assembly according to claim 1 wherein said secondary beams are formed from C or Z cold rolled metal sections.

4. An integrated roofing assembly according to claim 1 wherein said primary beams are spaced apart by a distance in a range from 4 to 12 meters.

5. An integrated roofing assembly according to claim 1 wherein the secondary beams are spaced apart by a distance in a range from 0.3 to 2 meters.

6. An integrated roofing assembly according to claim 1 wherein said ceiling tiles are plaster ceiling tiles supported by said suspended ceiling grid.

7. An integrated roofing assembly according to claim 1 wherein said assembly has a pitch of less than 10 degrees when fully assembled and installed.

8. An integrated roofing assembly according to claim 1 wherein the assembly further includes electrical wiring, lights, gutters, skylights, vents, fascias, insulation and ducting.

9. An integrated roofing assembly according to claim 1 further including transportable lifting means, wherein said transportable lifting means is one or more chain blocks or mobile cranes.

10. The integrated roof assembly according to claim 1 wherein said primary beams are adapted to extend between at least two vertical load bearing columns, said secondary beams are mounted on top of said primary beams, and said ceiling grid is positioned below said primary beams and suspended from said secondary beams.

11. The integrated roofing assembly according to claim 1 wherein said ceiling grid includes lighting and ventilation panels, and further including lights, wiring, and ventilation ducts.

12. The integrated roofing assembly of claim 1 in which said secondary beams are positioned on the upper surfaces of said primary beams.

13. The integrated roofing assembly of claim 2 in which said secondary beams are positioned on the upper surfaces of said primary beams.

14. The integrated roofing assembly of claim 3 in which said secondary beams are positioned on the upper surfaces of said primary beams.

15. The integrated roofing assembly of claim 4 in which said secondary beams are positioned on the upper surfaces of said primary beams.

16. The integrated roofing assembly of claim 5 in which said secondary beams are positioned on the upper surfaces of said primary beams.

17. The integrated roofing assembly of claim 8 in which said secondary beams are positioned on the upper surfaces of said primary beams.

18. The integrated roofing assembly of claim 9 in which said secondary beams are positioned on the upper surfaces of said primary beams.

19. The integrated roofing assembly of claim 10 in which said secondary beams are positioned on the upper surfaces of said primary beams.

20. A method of constructing and erecting an integrated roofing assembly, the method comprising the steps of:

laying out a ceiling grid on the ground;

laying out primary beams parallel to each other on said ceiling grid, with said ceiling grid being located beneath said primary beams;

installing load bearing columns around the periphery of said ceiling grid and primary beams, each of said primary beams adapted to extend between two of said columns;

fixing secondary beams to said primary beams in a direction transverse thereto to form a frame, said primary and secondary beams acting together to provide structural support for roof cladding members;

connecting said ceiling grid to said secondary beams;

installing electrical wiring and lights;

dropping ceiling tiles into position on said ceiling grid;

preparing lifting points on said primary or secondary beams;

lifting said roofing assembly into position on said load bearing columns using chain blocks or mobile cranes coupled to said lifting points;

securing said roofing assembly to said load bearing columns; and removing said chain blocks or mobile cranes.

21. A method according to claim 20 wherein the method further includes the step of bracing said load bearing columns to improve their load bearing capacity.

22. A method according to claim 21 wherein the method includes the steps of fixing roof cladding to the frame, installing insulation and installing gutters, skylights, vents and fascias before the step of lifting the roofing assembly into position.

23. A method according to claim 21 including the steps of constructing foundations, and forming a concrete slab, prior to the step of laying out the ceiling grid.

24. A method of constructing a building according to claim 21 wherein the method includes the following steps prior to constructing the foundations:

testing and assessing a site for the construction;

preparing the site ready for construction;

certifying the site for particular types of constructions; and maintaining the site ready for construction.

25. The method of claim 20 in which said secondary beams are fixed to the upper surfaces of said primary beams.

26. The method of claim 21 in which said secondary beams are fixed to the upper surfaces of said primary beams.

27. The method of claim 22 in which said secondary beams are fixed to the upper surfaces of said primary beams.

* * * * *

UNITED STATES PATENT AND TRADEMARK OFFICE

CERTIFICATE OF CORRECTION

PATENT NO. : 5,274,967
DATED : January 4, 1994
INVENTOR(S) : B. Mladichek

It is certified that error appears in the above-indentified patent and that said Letters Patent is hereby corrected as shown below:

Column 4, line 2:
"rid" should be --grid--.

Signed and Sealed this

Sixth Day of September, 1994

*Attest:*

Bruce Lehman

BRUCE LEHMAN

*Attesting Officer*

*Commissioner of Patents and Trademarks*